US005411184A

United States Patent [19]

Smrt

[11] Patent Number: 5,411,184

[45] Date of Patent: May 2, 1995

[54] ACTUATOR FOR AEROSOL CONTAINERS AND CORRESPONDING BASE

[76] Inventor: Thomas J. Smrt, 9716 S. Grant Hwy., Marengo, Ill. 60152

[21] Appl. No.: 140,250

[22] Filed: Oct. 21, 1993

[51] Int. Cl.[6] ..... B65D 83/20

[52] U.S. Cl. ..... 222/402.13; 222/402.1; 222/608; 239/150; 239/337

[58] Field of Search ..... 222/402.1, 402.13, 402.15, 222/402.22, 507, 608; 239/150, 273, 337

[56] References Cited

U.S. PATENT DOCUMENTS

| | | | |
|---|---|---|---|
| 2,555,826 | 6/1951 | Tallman | 239/150 X |
| 3,252,626 | 5/1966 | Belka | 222/182 |
| 3,422,996 | 1/1969 | Lipman | 222/402.11 |
| 3,485,206 | 12/1969 | Smrt | 118/305 |
| 3,700,144 | 10/1972 | Smrt | 222/176 |
| 3,756,514 | 9/1973 | Brown | 239/337 |
| 3,796,353 | 3/1974 | Smrt | 222/176 |
| 3,817,429 | 6/1974 | Smrt | 222/402.22 |
| 3,861,570 | 1/1975 | Green | 222/402.17 |
| 3,871,557 | 3/1975 | Smrt | 222/176 |
| 3,977,570 | 8/1976 | Smrt | 222/174 |
| 4,099,482 | 7/1978 | Smrt | 118/9 |
| 4,126,273 | 11/1978 | Smrt | 239/379 |
| 4,262,821 | 4/1981 | Smrt | 222/162 |
| 4,396,153 | 8/1983 | Smrt | 239/337 |
| 4,545,531 | 10/1985 | Williams | 239/150 |
| 4,946,104 | 8/1990 | Smrt | 239/150 |
| 5,287,998 | 2/1994 | Smrt | 239/337 |

FOREIGN PATENT DOCUMENTS

| | | |
|---|---|---|
| 372441 | 10/1983 | Austria . |
| 2045318 | 4/1979 | United Kingdom . |

*Primary Examiner*—Andres Kashnikow
*Assistant Examiner*—Joseph A. Kaufman
*Attorney, Agent, or Firm*—Leydig, Voit & Mayer, Ltd.

[57] ABSTRACT

An actuator and corresponding base assembly, as well as related systems for applying a mark onto a surface. The actuator has at least one pair of wings which extend from the actuator body, wherein the entire lower edge of each wing curves continuously outwardly and upwardly from the body. The base assembly comprises a base surface at least partially disposed in a base plane and an opening therethrough, at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of less than 90° to the base plane, the guides being capable of contacting an actuator as it is received in the base assembly and disposed relative to one another such that they rotate an actuator into a seated position in the base. The system comprises an aerosol container having an actuator and a movable marking device comprising the base of the present invention. Another system allows an operator to vary the width of a mark from an initial dimension.

44 Claims, 8 Drawing Sheets

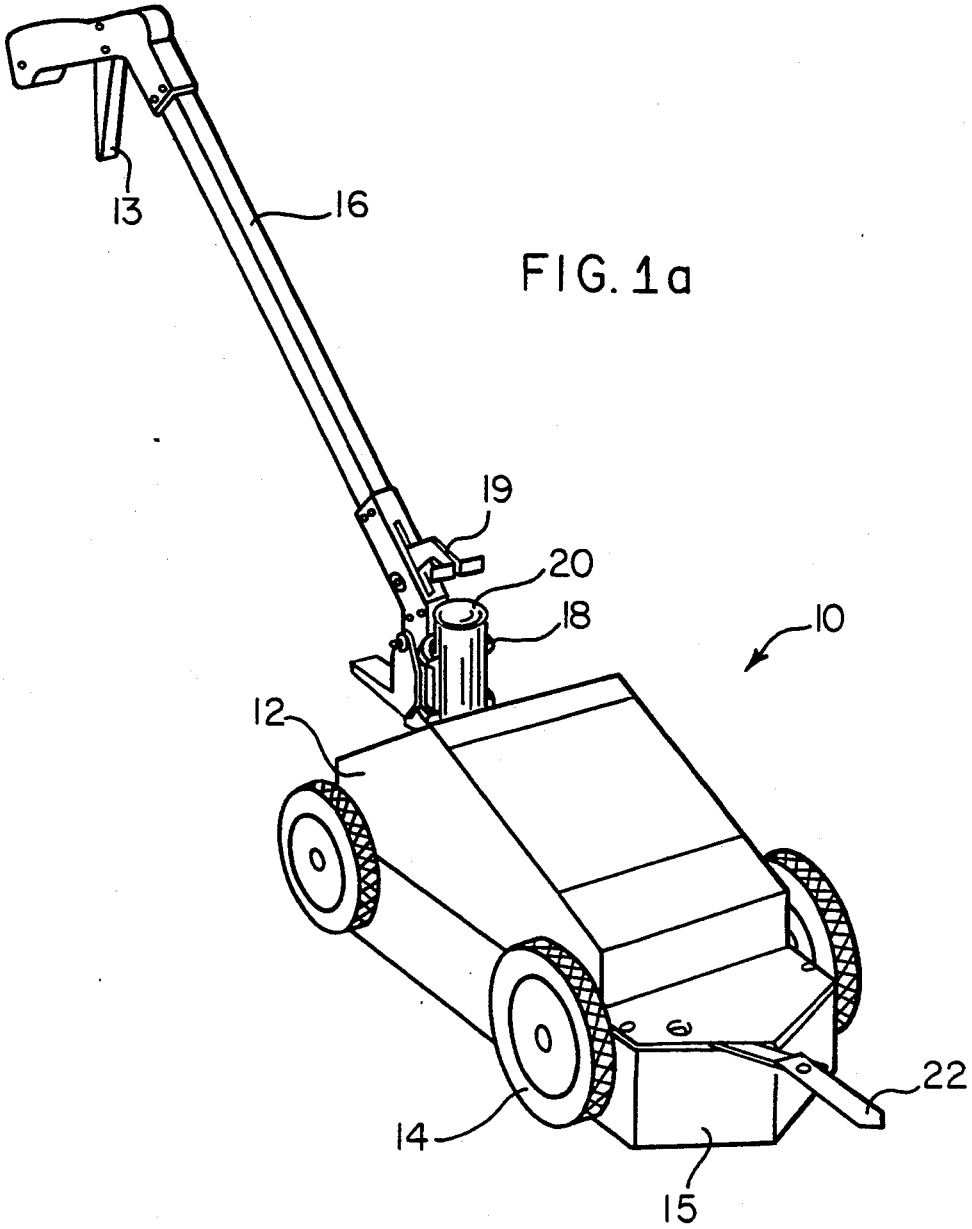
FIG. 1a
FIG. 3
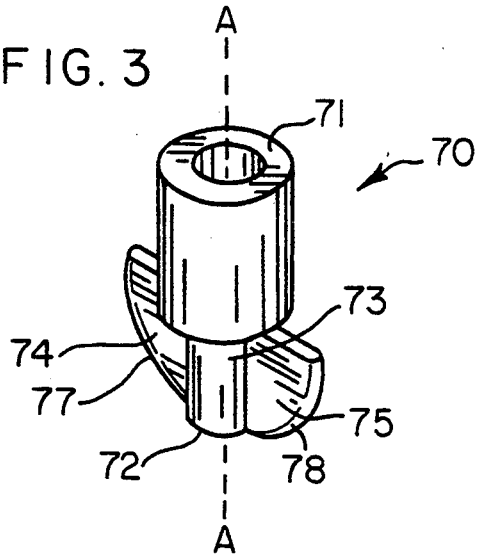
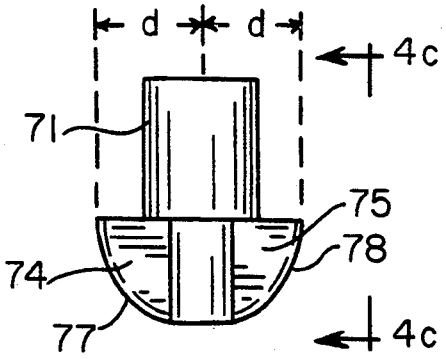
FIG. 4a

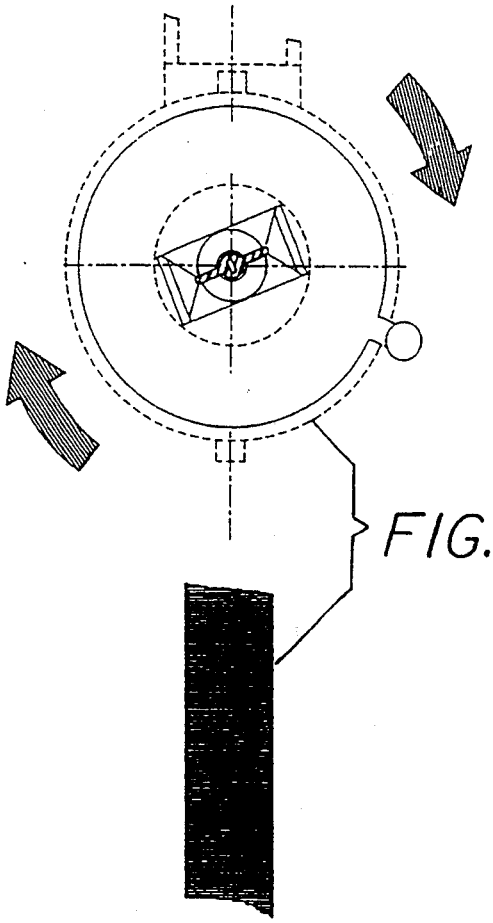
FIG. 12d
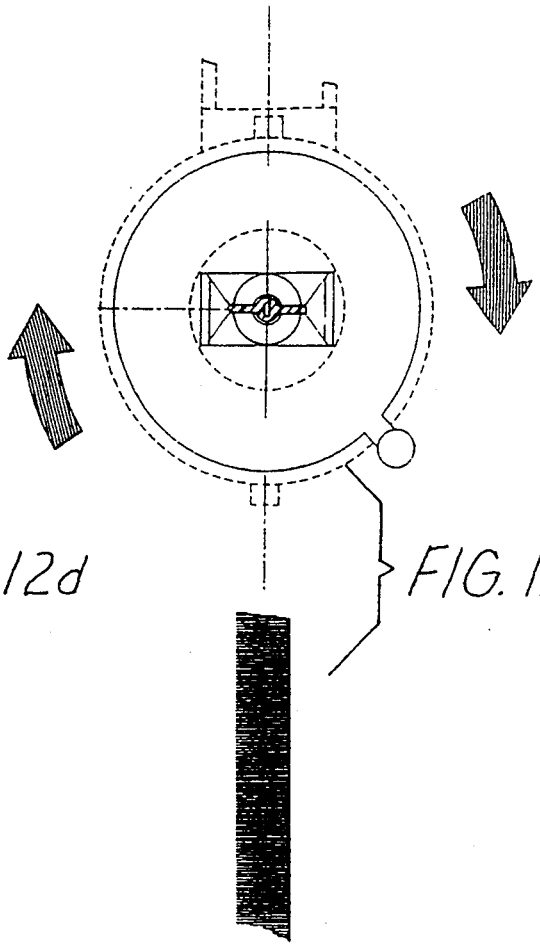
FIG. 12e
FIG. 13
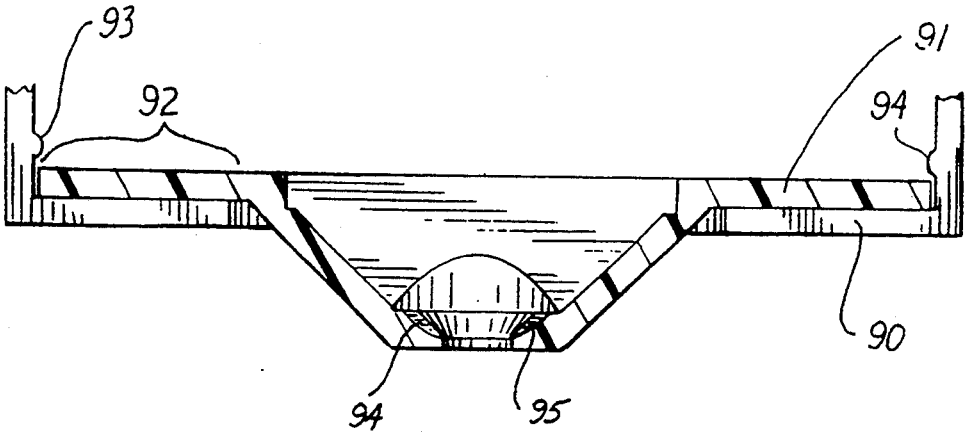

ACTUATOR FOR AEROSOL CONTAINERS AND CORRESPONDING BASE

TECHNICAL FIELD OF THE INVENTION

The present invention relates generally to an actuator, and corresponding base, for use in effecting the discharge of material from aerosol containers. The invention is particularly useful when it is desired to discharge material from the end, as opposed to a side, of an actuator, e.g., when striping a parking lot.

BACKGROUND OF THE INVENTION

Aerosol spray cans which are filled with marking material, such as paints, dyes, and the like, are frequently used in marking traffic and parking lines on pavement, boundary lines on athletic fields, restricted areas on golf courses, and other indicators, both permanent and non-permanent. When using an aerosol container to produce such marks, it is often desirable to provide an actuator which has an elongated, e.g., rectangular, orifice. The use of such an orifice helps ensure that the material, when discharged from the container, provides a well defined stripe of the desired width.

If an actuator with an elongated orifice is used in conjunction with a movable device to provide a stripe, the actuator is typically oriented with respect to the spraying device such that the longest dimension of the orifice is oriented perpendicular to the direction of movement of the device. In that regard, U.S. Pat. No. 4,126,273 is said to provide an actuator and actuator-orientator base assembly which is able to provide such perpendicular orientation. Moreover, that combination is said to provide for the automatic orientation of the actuator, and thus the orifice, upon insertion of the actuator into the orientator. The actuator provided thereby is generally in the shape of a large cylinder, with lugs protruding from its perimeter. The orientator into which the actuator is inserted includes a generally tubular wall and a radially outwardly flared upper portion. About half of the tubular wall is recessed, or notched, such that four curved or spiral guide surfaces are provided therein. Those guide surfaces terminate in a pair of diametrically opposed rectangular recesses. When the actuator is inserted into the orientator, the lugs engage the curved guide surfaces; the weight of the container causing the lugs to slide downwardly along those surfaces. During this sliding, the can and actuator rotate to bring the lugs into alignment with the recesses. Upon such alignment, the lugs drop into the recesses, this preventing any further rotation of the actuator.

Another actuator and base which may be used in connection with marking devices are disclosed in U.S. Pat. No. 4,396,153. The actuator disclosed therein has two pairs of rectangular wings which extend outwardly from opposing sides of an actuator body. Upon insertion of an aerosol can having such an actuator into the base disclosed therein, the actuator is rotated into the desired position. The patent states that the corners of the wing portions may be rounded to facilitate the insertion and alignment of the actuator.

However, the actuator disclosed therein will not automatically rotate and orient itself when introduced into the base regardless of the initial, pre-insertion, orientation of the actuator. A certain degree of pre-insertion alignment of the actuator, toward its final orientation in the base, is required of the operator. Without such pre-insertion alignment, the wings of the actuator may become wedged with respect to the base such that the actuator is unable to rotate.

U.S. patent application Ser. No. 07/987,583, filed Dec. 8, 1992, now U.S. Pat. No. 5,287,998 discloses yet another actuator, and a base configured to accept the actuator, which can be used in conjunction with a marking device. The base comprises a plurality of inclined planar surfaces which, upon complete insertion of the actuator in the base, function to laterally center the rectangular orifice with regard to the opening in the base. Such centering occurs irrespective of any dimensional imperfections present in the base and/or actuator. The actuator disclosed therein comprises at least one pair of wings wherein at least a portion of the bottom of the wings of the actuator angles linearly upward and away from the orifice. This configuration provides the aforesaid and other advantages when used in combination with the base. This actuator and base combination, however, also require a degree of pre-insertion alignment by the operator to ensure the proper final orientation of the actuator in the base.

Another aspect of operating a marking device is adjusting the device so as to achieve a smooth, uniform stripe of a desired width. Typically, adjustments are made by varying the distance between the orifice and the surface to be marked. However, that method requires moving the entire aerosol can holder into an appropriate position on the device each time one desires to produce a mark of a different width.

In view of the foregoing, there exists a need for an actuator and corresponding base which provide for the automatic proper orientation of the actuator, and as such the orifice, with respect to the base as the aerosol container is inserted into the base without regard to the initial orientation of the actuator with respect to the base and without requiring any manual pre-insertion orientation, or alignment, of the actuator by the user. There further exists a need for a means which would allow the width of a stripe of marking material to be easily varied, requiring a minimal amount of effort on the part of an operator.

These and other objects and advantages of the present invention, as well as additional inventive features, will be apparent from the description of the invention provided herein.

BRIEF SUMMARY OF THE INVENTION

The present invention fulfills the aforesaid need by providing means by which an actuator can be rotated about its axis and automatically properly oriented with respect to a base when inserted into the base. This is achieved without regard to the orientation of the actuator prior to its insertion into the base and without requiring any manual orientation of the actuator by an operator.

To that effect, the present invention provides an actuator having upper and lower ends and a passage therethrough which terminates in an orifice through which the material travels upon discharge from the container, the orifice located at the lower end of the actuator, the actuator comprising an actuator body having an axis which passes through the upper and lower ends thereof and at least one pair of wings which extend from the actuator body, each wing having a lower edge, which edge curves continuously outwardly and upwardly from the body.

A base assembly is further provided which is designed to receive and seat an aerosol container actuator. The aerosol container actuator which can be used with the aforesaid base should have an orifice at one end and be capable of receiving an aerosol container at a second end, the contents of the aerosol container being dischargeable through the orifice of the actuator. The base assembly comprises, in combination, a base surface at least partially disposed in a base plane and having an opening, the contents of the aerosol container being dischargeable through the orifice and the opening when the aerosol container actuator is seated within the base assembly, at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of less than 90° to the base plane, the guides being capable of contacting the actuator as it is received in the base assembly, the guides being disposed relative to one another such that they rotate the actuator to guide the actuator into the seated position.

The present invention further provides a system for applying a mark onto a surface. The system comprises an aerosol container having an actuator thereon, advantageously the aforesaid actuator of the present invention, and a movable marking device comprising a base assembly of the present invention.

In addition, the invention provides a rotatable insert which includes a base assembly configured to receive an actuator, advantageously the base assembly and actuator of the present invention. The insert, when rotated with respect to a marking device, provides a relatively easy means for varying the width of a stripe.

The invention may best be understood with reference to the accompanying drawings, wherein an illustrative embodiment is shown, and in the following detailed description of the preferred embodiment.

BRIEF DESCRIPTION OF THE DRAWINGS

FIG. 1*a* is a perspective view of a maneuverable marking device, the device being illustrated with an aerosol marking container inserted in a holder of the device.

FIG. 3 is a perspective view of the actuator configured in accordance with one embodiment of the present invention wherein the line A—A represents an axis of rotation of the actuator, FIG. 4*a* is a side view of the actuator of FIG. 3.

FIGS. 12*a*–12*e* are sequential illustrations of the base assembly of the present invention in a preferred embodiment, i.e., as incorporated into a rotatable insert, and the holder taken along line 12—12 of FIG. 1*b* as that base assembly is rotated 90° with respect to the marking device from a first position (FIG. 12*a*), wherein a relatively wide mark is produced, to a second position (FIG. 12*e*), wherein a relatively narrow mark is produced. In producing the mark shown in FIGS. 12*a*–12*e*, the base assembly in moved in a direction parallel to line 13—13 of FIG. 12*a*. The actuator of FIG. 3 is shown as being seated in the base assembly, with the orientation of the actuator orifice also being illustrated in the upper drawings of FIGS. 12*a*–12*e*. The lower drawings of those figures are a representation of the relative width of the mark that would be produced when the orifice is oriented in the position shown in the corresponding upper drawing.

FIG. 13 shows a cross-sectional view of the base assembly and holder taken along line 13—13 of FIG. 12*a* without the actuator shown in that figure being seated therein.

DESCRIPTION OF THE PREFERRED EMBODIMENTS

In accordance with the present invention, there is provided means for automatically orienting an actuator of an aerosol container into a desired position by rotating the actuator about its axis while the actuator is being inserted into a base, the base being advantageously located on a movable marking device, without regard to the orientation of the actuator prior to insertion into the base or requiring any pre-insertion orientation of the actuator by the operator of the device. In accordance therewith, there is provided an actuator, a base assembly configured to receive the actuator, preferably the actuator of the present invention, and a system which, upon integration onto a movable marking device, is used to apply a mark, preferably in the form of a stripe, on a surface. That system advantageously incorporates both the actuator and the base assembly of the present invention.

Figure 2:
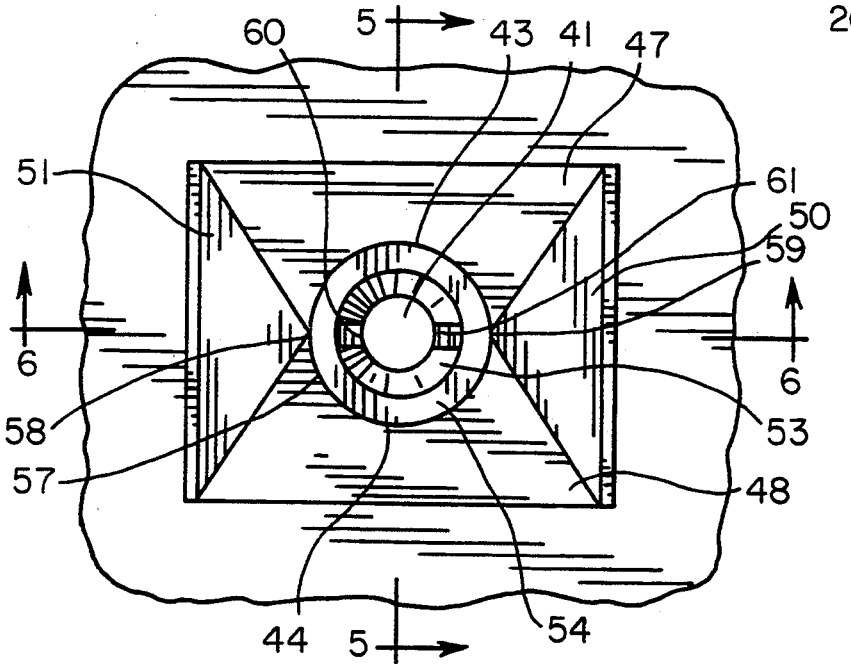
FIG. 2 is a fragmentary view of a first embodiment of the base assembly of the present invention taken along line 2—2 of FIG. 1*b*.

Turning initially to the base assembly of the present invention, a first embodiment thereof is illustrated in FIG. 2. That figure shows an assembly which is incorporated into a rotatable insert, which insert is designed to be inserted into the bottom of an aerosol can holder. Such an insert provides for the rotation of the base assembly with respect to the device. The configuration and operation of the insert will be discussed in detail infra. While the aforesaid design represents a preferred embodiment, the base assembly may otherwise be located into a fixed position on the device, e.g., molded into the bottom of the can holder.

The base assembly of the present invention, regardless of the manner in which it is incorporated into a marking device, is designed to receive and seat an aerosol container actuator, advantageously the actuator of the present invention. The aerosol container actuator used in connection with the base assembly should possess an orifice and be capable of receiving an aerosol container, the contents of the aerosol container being dischargeable through the orifice of the actuator. The base assembly itself comprises, in combination, a base surface at least partially disposed in a base plane and having an opening 41, the contents of an aerosol container being dischargeable through the orifice and the opening when an aerosol container actuator is seated within the base assembly, at least one wall extending upward from the base surface and defining two actuator-orienting guides 43, 44, the guides being defined by substantially arcuate-shaped profiles substantially disposed in respective guide planes, the guide planes being disposed at an angle to one another of less than 180° and at an angle of less than 90° to the base plane, the guides being capable of contacting the actuator as it is received in the base assembly and being disposed relative to one another such that they rotate the actuator to guide the actuator into the seated position.

The aforementioned base provides a unique means of orienting an actuator. Although any actuator which is able to orient itself upon insertion into the base assembly may be used, it is believed that such actuators should advantageously include at least two surfaces which project laterally with respect to the orifice. The surfaces should extend laterally such that contact is made between the surfaces and the guides as the actuator is inserted into the base assembly. This contact, which continues as the actuator is inserted into the base assembly, causes the actuator to rotate toward the desired orientation.

Figures 10A, 10B, 10C:
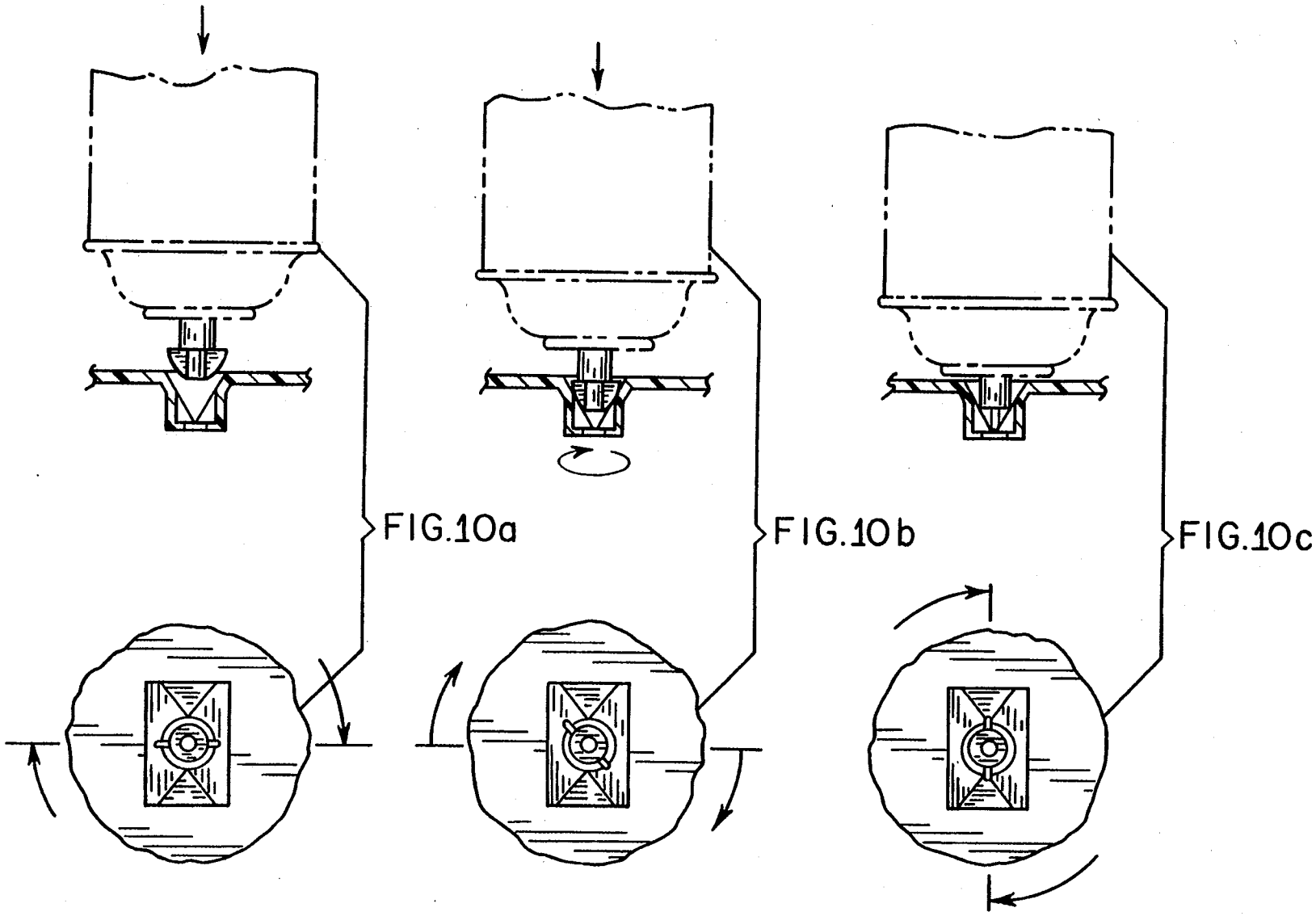
FIGS. 10*a*–10*c* are sequential illustrations of one possible direction of rotation, i.e., clockwise (as indicated by the arrows), that would be experienced by the actuator of FIG. 3 as that actuator is inserted into a base assembly of the present invention. Each figure includes a first and second drawing. The first, or upper, drawing illustrates a side view of the actuator (a container onto which the actuator is attached being shown in phantom) and base assembly in a particular orientation with respect to one another. The second, or lower, drawing illustrates a top view of the actuator and the base assembly in the orientation shown in the first drawing.
Figures 11A, 11B, 11C:
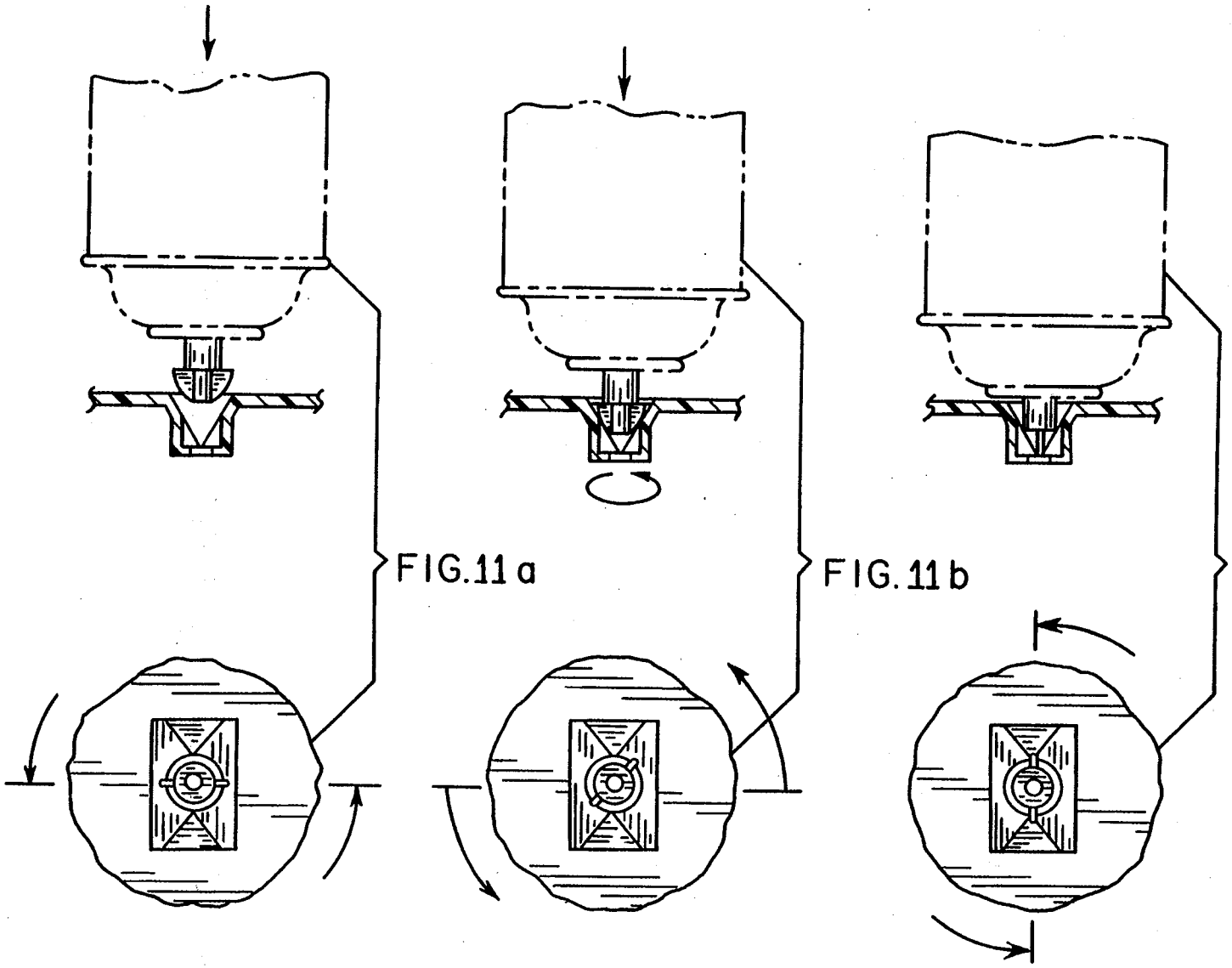
FIGS. 11*a*–11*c* are sequential illustrations of a second possible direction of rotation, i.e., counter-clockwise (as indicated by the arrows), that would be experienced by the actuator of FIG. 3 as that actuator is inserted into a base assembly of the present invention. Each figure includes a first and second drawing. The first, or upper, drawing illustrates a side view of the actuator (a container onto which the actuator is attached being shown in phantom) and base assembly in a particular orientation with respect to one another. The second, or lower, drawing illustrates a top view of the actuator and the base assembly in the orientation shown in the first drawing.

FIGS. 10*a*–10*c*, and FIGS. 11*a*–11*c*, illustrate the aforesaid actuator rotation; each set of figures showing such rotation in a different direction, i.e., clockwise and counter-clockwise (as indicated by the arrows), respectively. FIGS. 10*a* and 11*a* illustrate, advantageously, an actuator of the present invention (illustrated in FIG. 3), the actuator including two wings extending therefrom, and a base assembly of the present invention (illustrated in FIG. 2). The figures show a first and second drawing of the actuator and base assembly during insertion, at a time just prior to the actuator's contact with the base assembly. The second, or lower, of the two drawings in each figure (FIGS. 10*a* and 11*a*) exemplifies one possible orientation of the laterally extending surfaces with respect to the base assembly at that particular time, i.e., the wings are oriented at about 90° with respect to their final, seated, position in the base assembly. As the wings contact the guides, the actuator, due to its initial orientation, is rotated about its axis in one of two possible directions. FIG. 10*b* illustrates this rotation in a clockwise direction (indicated by the arrows) while FIG. 11*b* illustrates this rotation in a counter-clockwise direction (indicated by the arrows). FIGS. 10*c* and 11*c* illustrate the actuator after it has rotated 90° from its original orientation (as shown in FIGS. 10*a* and 11*a*), i.e., the actuator is shown in its final, seated, position on the base assembly. Of course, the actuator will rotate about its axis regardless of its initial orientation, the only difference being the direction and extent of such rotation of the actuator about its axis.

Figure 7:
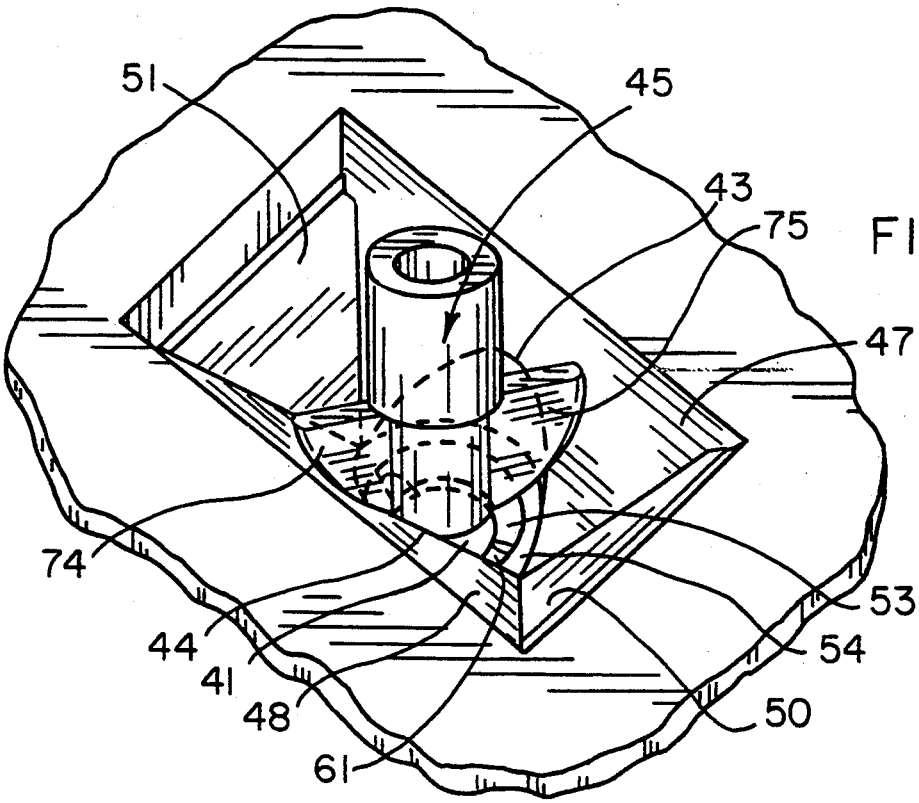
FIG. 7 is a perspective view of the actuator of FIG. 3 and the base assembly of FIG. 2 which illustrates rotation of the actuator about its axis of rotation due to contact of the actuator with actuator guides of the base assembly.

The previously described rotation and interaction between the actuator and base assembly which results in the aforesaid rotation may be better illustrated upon reference to FIG. 7. Turning to that figure (in which the base assembly of FIG. 2 is illustrated), there is shown an opening 41 and two actuator-orienting guides 43, 44. When an actuator 45 is inserted into the base (the actuator of FIG. 3 being shown in FIG. 7), it is contemplated that each of the laterally extending surfaces of the actuator, which will be referred to herein as wings, will, at some point in time during the insertion, come into contact with one of the guides 43, 44. Thus, the distance between the furthest extension of each wing which contacts the guides should be greater than the maximum distance between the guides. As the actuator is further lowered into the base, the downward slope of the guides causes the actuator wings to be rotated about the actuator axis. This in turn causes the actuator, and hence the orifice, to rotate toward its desired orientation. FIG. 7 shows such contact and the actuator 45 which is at least partially rotated toward the desired orientation. Advantageously, the wings will extend from the actuator body a distance such that the wings remain in contact with the guides at least until the desired orientation of the orifice is attained.

The orientation of the planes which define the arcuate actuator-orienting guides may be better described with reference to FIG. 5. In that figure, the orientation of the aforesaid planes is represented by the extensions C—C and D—D and the base plane by the extension B—B. Those extensions are provided so as to allow illustration of the angles between the guide and base planes, i.e., $\alpha$, $\beta$, and $\gamma$, thereby clearly describing their orientation with respect to one another. In particular, the planes in which the guides lie are advantageously inclined at an angle $\beta$, $\gamma$, of from about 20° to about 80°, preferably from about 35° to about 65°, and most preferably about 45° with respect to the base plane. The aforesaid degree of inclination, in addition to assisting the rotation of the actuator during insertion, further assists in positioning the actuator with respect to the opening such that material discharged from the orifice passes through the opening. In addition, the angles of inclination of such planes with respect to the base plane are preferably substantially identical, i.e, within about 5° of each other. In such a case, the angle between those actuator-orienting guide planes, i.e., $\alpha$, should be less than 180°, advantageously range from about 20° to about 140°, preferably range from about 50° to about 110°, and most preferably be about 90°.

It is preferable that the planes which define the arcuate actuator-orienting guides intersect each other on the base surface. This intersection is clearly shown in, e.g., FIGS. 2, 5 and 7. This orientation provides for the orifice to be both centered with respect one dimension of the opening as well as being properly oriented in the base.

Returning to FIG. 2, when inserting a container into the base assembly, it is often the case that the actuator will not initially contact the guide surfaces. As such, the base assembly of the present invention advantageously further includes a first set of two planar surfaces 47, 48. Each planar surface of the first set extends upwardly and outwardly with respect to one of the guides and from at least a portion of said guide. Such surfaces ensure that the actuator contacts the guide by deflecting the actuator onto the guide.

The aforesaid problem may also occur in the transverse direction. As such, the base assembly further advantageously comprises a second set of two planar surfaces 50, 51. Each second planar surface extends upwardly from the first surface and outwardly with respect to the opening and contacts both of the first planar surfaces 47, 48.

Figure 6:
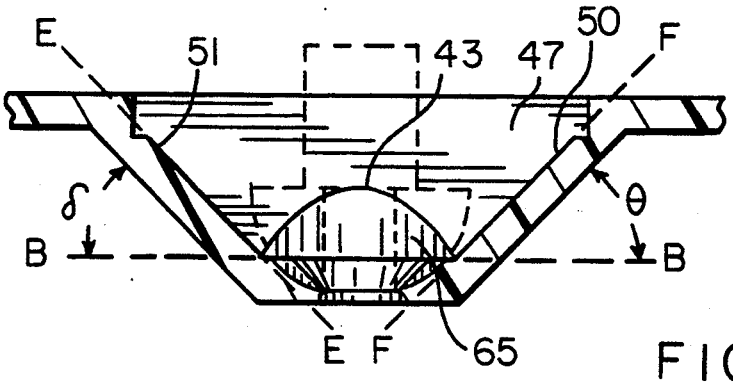
FIG. 6 is a cross-sectional view of the base shown in and taken along line 6—6 of FIG. 2 with the actuator of FIG. 3 shown in phantom.

The orientation of the second set of planar surfaces 50, 51 may be better described with reference to FIG. 6. In that figure, the orientation of the surfaces is represented by the extensions E—E and F—F and the base plane by the extension B—B. Those extensions are provided so as to allow illustration of the angles between the second set of surfaces and the base plane, i.e., $\delta$ and $\theta$.

In order to assist the positioning of the actuator onto the guide surfaces, each first and second planar surface is advantageously inclined at an angle $\beta$, $\gamma$, $\delta$, $\theta$ of from about 20° to about 80°, preferably from about 35° to about 65° and most preferably at about 45° with respect to the base plane. Further, the angle of one planar surface with respect to its counterpart planar surface, i.e., $\beta$ and $\gamma$, $\delta$ and $\theta$, is advantageously substantially the same, within about 5°. Preferably, the angles of each first and second planar surface with respect to the base plane $\beta$, $\gamma$, $\delta$, $\theta$ are substantially equal.

It should be appreciated that those surfaces of the base which potentially or actually contact an actuator upon insertion have no recesses or other guide means formed therein. All of such surfaces, whether curved or planar, are smooth, i.e., they lack such recesses.

Figure 9:
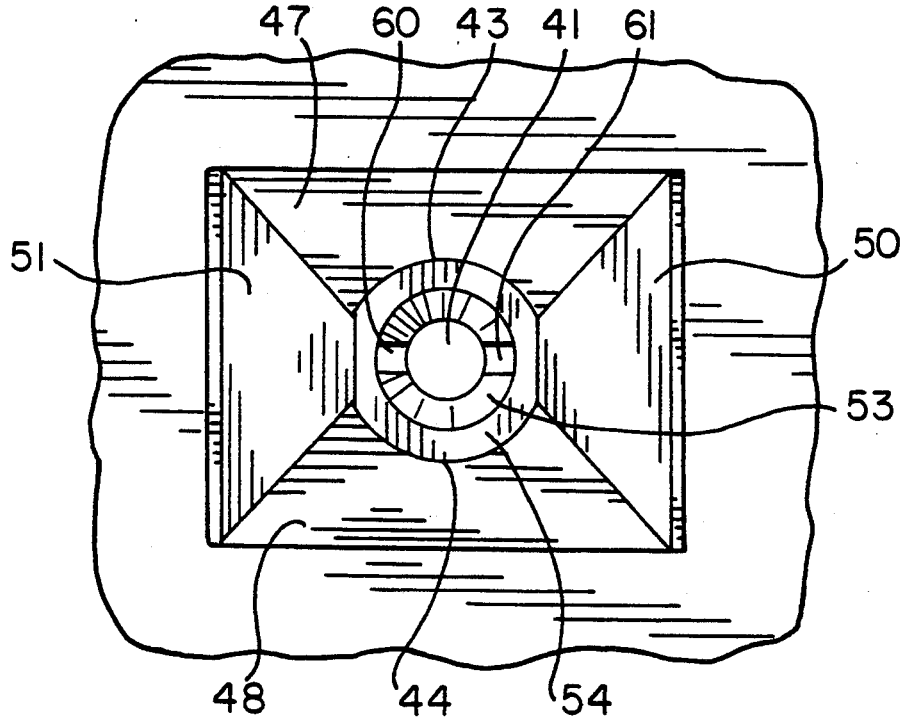
FIG. 9 is a fragmentary, perspective view of a second embodiment of the base assembly of the present invention.

Moreover, and advantageously, a portion of the base surface which surrounds the opening extends upwardly and outwardly from the opening such that the base plane is defined. More specifically, and returning to FIG. 2, the base surface is preferably comprised of two annular surfaces 53, 54. A first annular surface 53 surrounds the opening and extends upwardly and outwardly from the opening. A second annular surface 54, which lies within the base plane, extends outwardly from the first annular surface. Preferably, the outermost perimeter of the second annular surface 54 is a circle 57, the circle having a diameter which is equivalent to the distance between the intersections 58, 59 formed by each second planar surface, the terminal points of each guide, and the second annular surface. A second embodiment of the base assembly, as illustrated by FIG. 9, calls for the outermost perimeter of the second annular surface 54 to be comprised of two arcs, e.g., semi-circles, which are joined by a straight edge. The remainder of the components remain as described herein with regard to the first embodiment.

Figure 5:
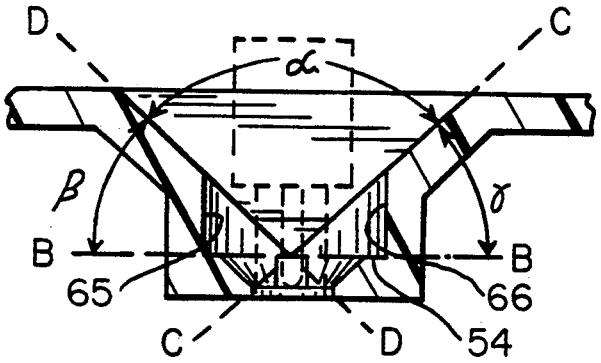
FIG. 5 is a cross-sectional view of the base assembly shown in and taken along line 5—5 of FIG. 2 with the actuator of FIG. 3 shown in phantom.

The base further advantageously includes two curved walls 65, 66 which are best shown in FIG. 5. One wall extends downwardly from each guide and intersects the aforesaid circle 57 such that there is no opening through the base other than the opening through which marking material is passed. Advantageously, each curved wall 65, 66 is perpendicular with respect to the second annular surface 54.

Figure 8:
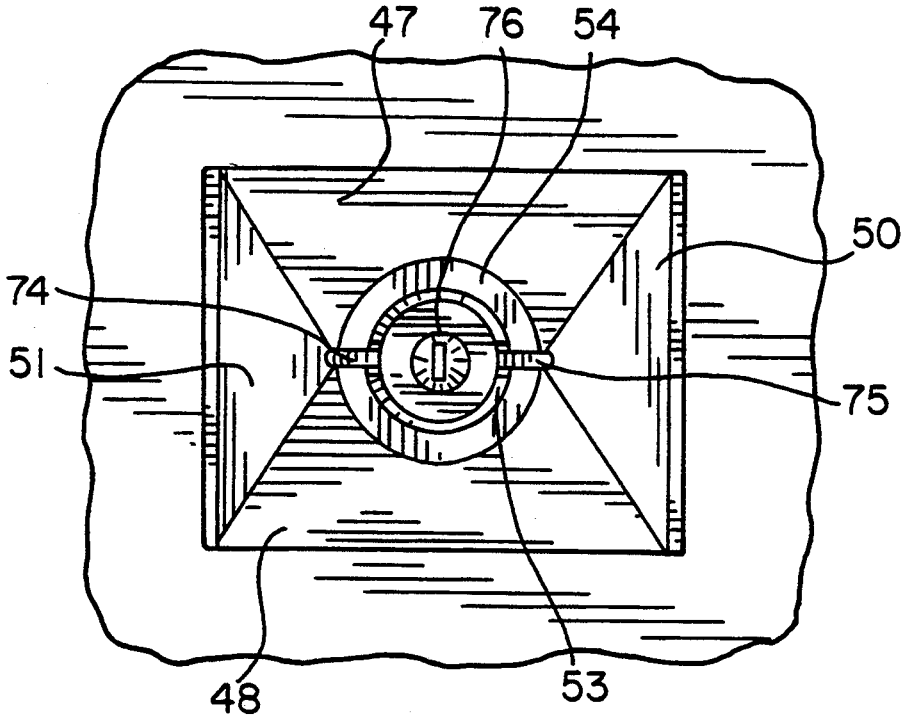
FIG. 8 is a fragmentary view of the base assembly of FIG. 2 with the actuator of FIG. 3 being seated in the base assembly.

Turning again to FIG. 2, a plurality of channels 60, 61 located on the base surface surrounding the opening is further advantageously included in the base assembly. Preferably, such channels are located on the first annular surface 53. The channels are provided such that, when an actuator, and preferably an actuator of the present invention, is properly oriented and seated in the base assembly, the wings will engage such channels. It is contemplated that one wing will engage a single channel. This preferred engagement, wherein one wing engages a single channel (as illustrated in FIG. 8, wherein the actuator in FIG. 3 is shown seated in the base assembly of FIG. 2) provides a stable engagement of the actuator in the base and prevents further rotation of the actuator after same is fully seated and properly oriented in the base assembly.

While many actuators are known in the art, the present invention provides a novel actuator which possesses various advantages over known actuators. One embodiment of the actuator of the present invention is illustrated in FIG. 3. The actuator 70 shown therein has upper and lower ends 71, 72 and a passage therethrough (not shown) which terminates in an orifice (illustrated in FIG. **4*b* as indicia 76), located at the lower end 72, through which the material travels upon discharge from the container. Although the orifice is illustrated in one orientation (perpendicular) with respect to the wings, it should be appreciated that the orifice may be oriented with respect to the wings any suitable manner. A line which passes through both the upper and lower ends of the actuator, as indicated by the line A—A in FIG. 3**, defines an axis about which the actuator rotates.

The actuator comprises an actuator body 73 and at least one pair of wings 74, 75 which extend from the actuator body. Those wings, which may be offset with respect to each other, but which are advantageously located directly opposite each other, are preferably prepared from a material which is rigid such that the wings do not deform, or flex, when the actuator is inserted into a base assembly. Such rigidity ensures that the actuator rotates smoothly and properly as it is inserted into the base such that, upon completion of its rotation, the actuator is properly oriented.

Each wing possesses a bottom surface 77, 78. Each bottom surface curves continuously outwardly and upwardly from the body, toward the upper end of the body. Turning to FIG. **4*a*, which is a side view of the actuator of FIG. 3**, it should be appreciated that the radius of the curve of each edge, and the distance each surface extends from the center line of the actuator body (as indicated by the indicia "d"), are selected such that the actuator rotates about its axis and properly orients itself with respect to a base assembly when inserted therein. Such occurs regardless of the orientation of the actuator prior to its insertion into the base assembly.

The curvature of the bottom surfaces is provided so as to provide more expedient rotation of the actuator upon insertion into the base assembly as compared to a non-curved bottom surface. Advantageously, the lower edges of the wings will curve along a constant radius so as to provide smooth insertion. More advantageously, the wings and bottom of the body form a continuous upwardly curved surface, the curve extending at each end toward the upper end of the body. In such a case, however, the orifice is advantageously planar in order to ensure the even dispersal of marking material therefrom.

Figure 4B:
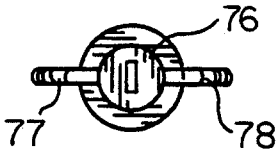
FIG. 4*b* is a bottom view of the actuator of FIG. 3.
Figure 4C:
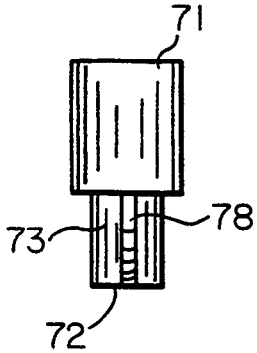
FIG. 4*c* is a side view of the actuator taken along line 4*c*—4*c* of FIG. 4*a*.

Further, and preferably, at least a portion of the lower edges of the wings are rounded or beveled in the direction which is transverse to the direction of curvature. Rounding of the edges may best be seen in FIG. 4*b*. Configuring the surface in this manner serves to minimize the area of contact between the guides and the wings. This minimizes friction between those components which in turn results in both increased ease and speed of insertion. It will be appreciated that the aforementioned benefits can be obtained by the use of such beveling or rounding without regard to the thickness of the wings, e.g., if a relatively thick wing is required to provide the preferred rigid, inflexible wing.

As mentioned previously, upon insertion into a base assembly, the actuator of the present invention will rotate about its axis. While the actuator may rotate in full or partial synchronicity with any rotation of the container, it is preferred that the actuator be mounted on the container such that the actuator freely rotates about its axis independently of any rotation of the container.

The actuator and base assembly of the present invention may be prepared from any suitable material. The selection of the appropriate material and methods of preparation of such an actuator and base assembly are well within the skill of those of ordinary skill in the art.

The present invention further provides a system for applying a mark onto a surface. The system comprises an aerosol container having an actuator, preferably an actuator of the present invention, which effects the discharge of marking material from the container, in combination with a movable marking device, either wheeled, e.g., U.S. Pat. Nos. 4,641,780, 4,895,304, 4,943,008, 4,946,104, and 5,148,988, or hand-held, e.g., U.S. Pat. No. 3,977,570, which includes a base assembly of the present invention, as described previously herein.

Alternatively, the system of the present invention can be described as comprising a movable marking device comprising a base assembly, the base assembly being designed to accept an actuator, the base assembly having an opening therein through which the marking material passes after being discharged through the actuator. The base assembly itself comprises a base surface extending outwardly from an opening, two actuator-orienting guides, each guide being defined by a substantially arcuate profile which extends upwardly from the first surface and being substantially disposed in a plane which originates from the first surface. The actuator used in the system has a body which includes upper and lower ends, and axis which passes through the upper and lower ends of the body, a plurality of wings extending laterally from the actuator body a predetermined length, and a passage through the actuator which terminates in an orifice through which marking material travels upon discharge from the container, with the orifice being located at the lower end of the actuator body. The guides of the base assembly are oriented with respect to the base surface and the opening, and the length of the actuator wings is selected, such that when the actuator is inserted into the base assembly, the wings contact the guides and cause the actuator to rotate about its axis and orient the orifice with respect to the opening in the base surface such that marking material discharged from the actuator passes through the opening regardless of the orientation of the actuator prior to its insertion into the base assembly.

By way of providing an example of the aforesaid system of the present invention, FIG. 1*a* illustrates an exemplary movable marking device 10 which is designed to apply a stripe of marking material onto a surface. Such a device generally comprises a housing 12, wheels 14, and a handle 16. As a convenience, a pointer 22 may also be included on the device 10, this assisting an operator in moving the device along a desired path. A counterbalancing member 15 may be advantageously appended to the device 10 to assist in, as the name implies, counterbalancing the downward force applied to the handle by the operator when maneuvering the device.

Figure 1B:
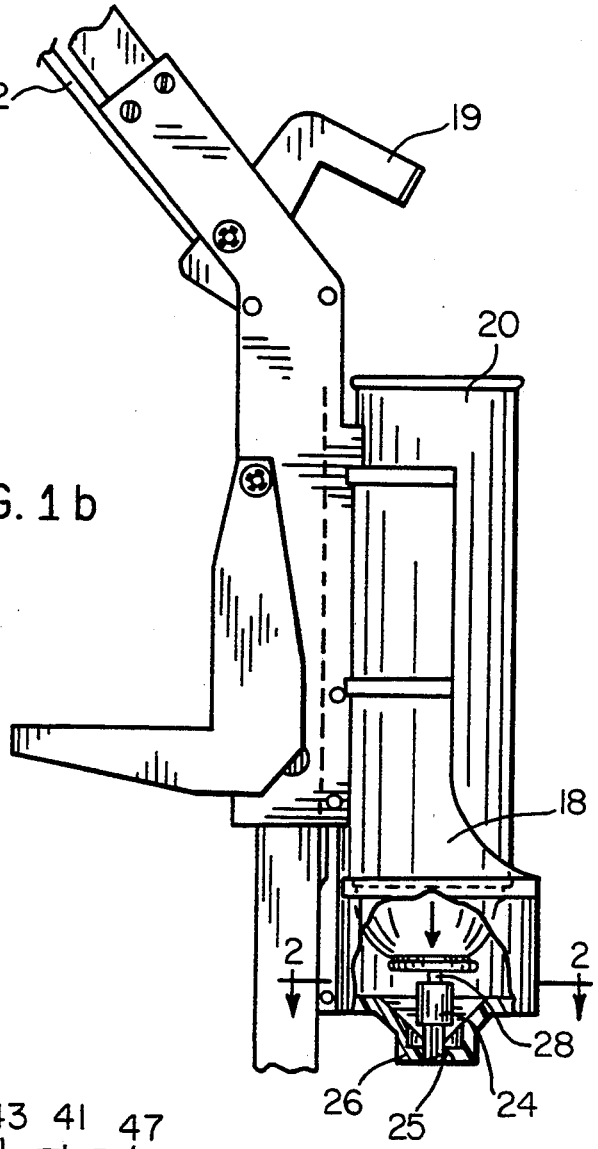
FIG. 1*b* is a side view of the aerosol marking container and holder shown in FIG. 1*a* in which the aerosol container is positioned in the holder of the marking device.

The handle 16 itself, although previously described as a means by which an operator may maneuver the device, also provides a means by which the discharge of the contents of an aerosol container may be effected. More specifically, the handle 16 includes a holder 18 which is configured to receive, and secure therein, an aerosol container 20. FIG. 1*b*, which is an enlarged view of a portion of the handle of FIG. 1*a*, illustrates such a container 20 mounted securely within the holder 18. The container 20 is inserted in an inverted position in the holder 18 such that the marking material may be applied in a downward direction, onto a surface over which the device traverses. Upon insertion, the actuator is properly oriented with respect to the base assembly, and device, as previously described.

In order to effect a discharge of marking material from the device 10, a container 20, which includes an actuator 24, preferably one of the present invention, is placed into the holder 18. When inserted properly, the container 20 rests upon a base assembly 26 of the holder 18. An actuator rod 32, which is operated by a trigger 13 (see FIG. 1*a*) located on an upper end of the handle assembly 16, is used to rotate an actuating lever 19 such that the lever contacts the bottom 30 of the container and an internal container and forces the container toward the base assembly 26. This in turn causes the internal container valve to open, wherein the contents of the container 20 are forced through and out of the container by pressure which is provided by a suitable propellant located within the container.

After the contents of the container 20 pass through the valve, they continue through a valve stem 28 and enter the actuator 24. In that actuator 24, the contents pass through a passage (not shown) and subsequently are discharged into the atmosphere through an orifice (not shown). After the contents of the can 20 pass through the orifice, the contents pass through an opening 25 in the base assembly 26 (see FIG. 2), through the interior of the housing 12, and onto the surface over which the marking device 10 is located.

Figures 12A, 12B, 12C:
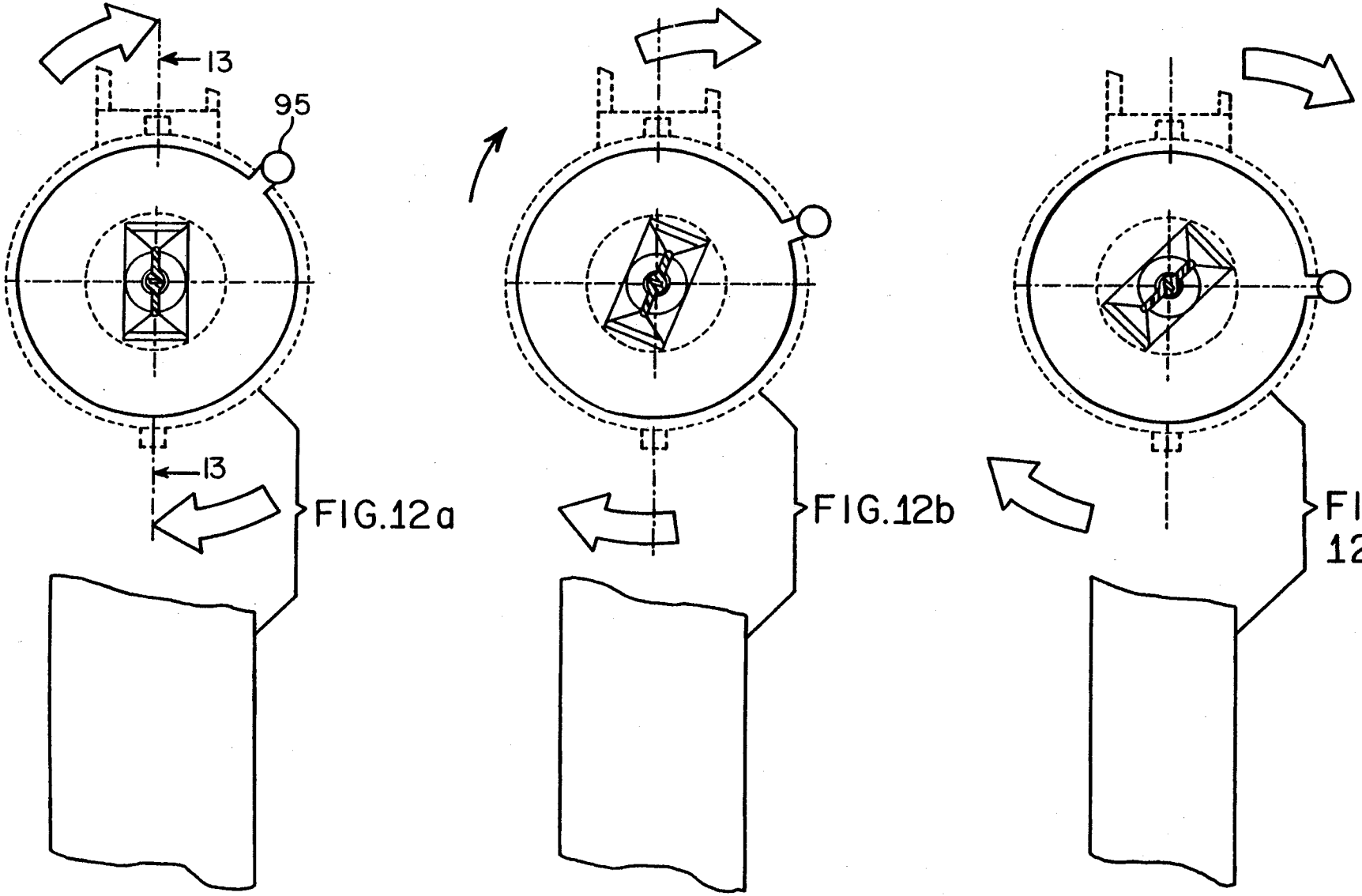

As mentioned previously, a further system is provided by the present invention which incorporates a rotatable insert having a base assembly for accepting an actuator, advantageously the base assembly and actuator of the present invention. This system provides one with a relatively simple and easily operable means by which the width of a mark can be varied. As illustrated in FIG. 12*a*, the system comprises an aerosol container (not shown) having an actuator, preferably an actuator of the present invention (the actuator of FIG. 3 being shown therein), and a rotatable insert, e.g., a disk, which incorporates a base assembly configured to receive an actuator, advantageously the base assembly of the present invention. The system further includes a movable marking device having an opening therethrough and a planar surface about the opening.

The actuator of that system comprises a body which includes upper and lower ends, an axis which passes through the upper and lower ends of the body, a plurality of wings extending laterally from the actuator body a predetermined length, and a passage through the actuator which terminates in a substantially rectangular orifice through which marking material travels upon discharge from the container, the orifice located at the lower end of the actuator body.

FIG. 13, which is a sectional view taken along line 13—13 of FIG. 12*a*, more clearly illustrates a preferred embodiment of the aforesaid system. In that figure, a holder 90 into which the aerosol container is inserted is shown, the holder comprising a substantially cylindrically-shaped side wall and a bottom surface. An opening in the bottom of the holder, which is preferably cylindrical, is also provided. Also illustrated is a circular insert 91 which is rotatable with respect to the device, as well as with respect to the holder. The insert comprises a base assembly which comprises: (a) a base surface extending outwardly from an opening, the base surface having a means for receiving and seating the actuator therein such that the actuator rotates when the insert is rotated, (b) flange means integral with and extending from the base assembly such that the means contacts the planar surface about the device opening, and (c) handle means for effecting rotation of the insert by an operator.

FIG. 13 shows the base assembly of FIG. 2 incorporated into a circular insert. That insert includes two channels 94, 95 which receive and seat an actuator such that the actuator rotates when the insert is rotated. Also illustrated is an annular flange means 92 which surrounds the base assembly and contacts the bottom of the holder 90. The outermost perimeter of the flange means should advantageously extend to the inner wall of the holder in order to maintain the base assembly centered with respect to the opening in the holder but not so far as to prevent free rotation of the insert. The side walls of the holder advantageously include a plurality of protrusions 93, 96 which extend inwardly form the wall. Those protrusions function to prevent unwanted movement of the insert away from the bottom of the holder.

The insert further includes handle means 95 (illustrated in FIG. 12*a*) which allow an operator to rotate the insert, and thus the base assembly and actuator, with respect to the holder and, as such, the device. Advantageously, the handle means protrudes through an opening in the side wall of the holder (not illustrated).

Any suitable means may be used to maintain the insert in the desired rotational position with respect to the holder and/or device, such being well known in the art.

The aforedescribed components are provided such that, when an operator moves the handle means, the actuator rotates about its axis, causing the orifice to rotate such that the mark prepared by the discharge of material from the orifice varies in width.

The foregoing effect may be more clearly appreciated upon reference to FIGS. 12*a*–12*e*. The upper drawings of those series of figures illustrate the insert of the present invention taken along line 12—12 of FIG. 1*b*. As the upper drawings demonstrate, as the handle is moved with respect to the holder, the insert, and thus the base assembly and actuator, is rotated 90° with respect to the marking device from a first position (shown in FIG. 12*a*), wherein a relatively wide mark is produced, to a second position (FIG. 12*e*), wherein a relatively narrow mark is produced. The actuator of FIG. 3 is shown in those figures as being seated in the base assembly, with the orientation of the actuator orifice as the insert is rotated also being illustrated. The lower drawings included in those figures represent the relative width of the mark that would be provided when the insert, and thus the orifice of the actuator, is oriented in the position shown in the top drawing. All of the drawings assume that the direction of movement of the device is parallel to a path defined by the line 13—13 of FIG. 12*a*.

All of the references cited herein are hereby incorporated in their entireties by reference.

While this invention has been described with an emphasis upon preferred embodiments, it will be obvious to those of ordinary skill in the art that variations of the preferred products may be used and that it is intended that the invention may be practiced otherwise than as specifically described herein. Accordingly, this invention includes all modifications encompassed within the spirit and scope of the invention as defined by the following claims.

What is claimed is:

1. A base assembly for receiving and seating an aerosol container actuator, the aerosol container actuator having an orifice and capable of receiving an aerosol container, the contents of the aerosol container being dischargeable through the orifice of the aerosol container actuator, the base assembly comprising, in combination, a base surface at least partially disposed in a base plane and having an opening, the contents of the aerosol container being dischargeable through the orifice and the opening when the aerosol container actuator is seated within the base assembly, at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of less than 90° to the base plane, the guides being capable of contacting the actuator as it is received in the base assembly, the guides being disposed relative to one another such that they rotate the actuator to guide the actuator into the seated position.

2. The base assembly of claim 1, wherein the planes which define the arcuate actuator-orienting guides intersect each other on the base surface.

3. The base assembly of claim 1, wherein the planes which define the arcuate actuator orienting guides are inclined at an angle of from about 20° to about 80° with respect to the base plane.

4. The base assembly of claim 3, wherein the planes which define the arcuate actuator-orienting guides intersect each other on the base surface.

5. The base assembly of claim 4, wherein the planes which define the arcuate actuator-orienting guides are inclined at an angle of from about 35° to about 65° with respect to the base plane.

6. The base assembly of claim 1, the base further comprising a first set of two planar surfaces, each planar surface of the first set extending upwardly and outwardly with respect to one of the guides and from at least a portion of said guide.

7. The base assembly of claim 6, the base further comprising a second set of two planar surfaces, each planar surface of the second set extending upwardly and outwardly with respect to the opening and contacting each planar surface of the first set.

8. The base assembly of claim 7, wherein each first and second planar surface of the first and second sets of planar surfaces is inclined at an angle of from about 20° to about 80° with respect to the base plane.

9. The base assembly of claim 8, wherein the planes which define the arcuate actuator-orienting guides are inclined at an angle of from about 20° to about 80° with respect to the base plane.

10. The base assembly of claim 9, wherein the planes which define the arcuate actuator-orienting guides intersect each other on the base surface.

11. An actuator for effecting discharge of material from an aerosol container upon insertion into a base, the actuator having upper and lower ends and a passage therethrough which terminates in an orifice through which the material travels upon discharge from the container, the orifice located at the lower end of the actuator, comprising an actuator body having an axis which passes through the upper and lower ends thereof, and at least one pair of wings which extend from the actuator body, each wing having a lower edge, the entire lower edge curving continuously outwardly and upwardly from the body.

12. The actuator of claim 11, wherein the lower edges of the wings curve along a constant radius.

13. The actuator of claim 12, wherein at least a portion of the lower edges of the wings are rounded in the direction which is transverse to the direction of curvature.

14. The actuator of claim 11, wherein at least a portion of the lower edges of the wings are rounded in the direction which is transverse to the direction of curvature.

15. The system of claim 11, wherein the lower end of the actuator body and the lower edges of the at least one pair of wings together define an upwardly curved surface.

16. The actuator of claim 11, wherein at least a portion of the lower edges of the wings are beveled in the direction which is transverse to the direction of curvature.

17. A system for applying a mark onto a surface comprising an aerosol container having an actuator, the actuator having a body which includes upper and lower ends, an axis which passes through the upper and lower ends of the body, a plurality of wings extending laterally from the actuator body a predetermined length, and a passage through the actuator which terminates in an orifice through which marking material travels upon discharge from the container, the orifice located at the lower end of the actuator body, and a movable marking device which comprises a base assembly, the base assembly having an opening through which the marking material passes after being discharged through the actuator, the base assembly comprising a base surface extending outwardly from the opening and two actuator-orienting guides, each guide being defined by a substantially arcuate profile which extends upwardly from the first surface and is substantially disposed in a plane which originates from the first surface, wherein the guides are oriented with respect to the base surface and the opening and the length of the actuator wings is selected such that when the actuator is inserted into the base assembly the wings contact the guides and cause the actuator to rotate about its axis and orient the orifice with respect to the opening in the base surface such that marking material discharged from the actuator passes through the opening regardless of the orientation of the actuator prior to its insertion into the base assembly.

18. The system of claim 17, wherein each wing has a lower edge, and the entire lower edge of each wing curves continuously outwardly and upwardly from the body.

19. The system of claim 17, wherein each wing has a lower edge, and the lower edge of each wing curves along a constant radius.

20. The system of claim 17, wherein the plurality of wings comprise at least one pair of wings, each wing has a lower edge, and the lower end of the actuator body and the lower edges of the at least one pair of wings together define an upwardly curved surface.

21. The system of claim 17, wherein the length of the actuator wings is selected such that when the actuator is inserted into the base assembly and the wings contact the guides, the wings remain in contact with the guides until the wings contact the base surface.

22. The system of claim 17, wherein the planes which define the arcuate actuator-orienting guides intersect each other on the base surface.

23. The system of claim 22, wherein the length of the actuator wings is selected such that when the actuator is inserted into the base assembly and the wings contact the guides, the wings remain in contact with the guides until the wings contact the base surface.

24. The system of claim 17, wherein the planes which define the arcuate actuator-orienting guides are inclined at an angle of from about 20° to about 80° with respect to the opening plane.

25. The system of claim 24, wherein each wing has a lower edge and the entire lower edge of each wing curves continuously outwardly and upwardly from the body.

26. The system of claim 24, wherein the planes which define the arcuate actuator-orienting guides intersect each other on the base surface.

27. The system of claim 26, wherein each wing has a lower edge and the lower edge of each wing curves along a constant radius.

28. The system of claim 26, wherein the planes which define the arcuate actuator-orienting guides are inclined at an angle of from about 35° to about 65° with respect to the opening plane.

29. The system of claim 17, the base assembly further comprising a first set of two planar surfaces, each planar surface of the first set extending upwardly and outwardly with respect to one of the guides and from at least a portion of said guide.

30. The system of claim 29 the base assembly further comprising a second set of two planar surfaces, each planar surface of the second set extending upwardly and outwardly with respect to the opening and contacting each planar surface of the first set.

31. The system of claim 30, wherein each first and second planar surface of the first and second sets of planar surfaces is inclined at an angle of from about 20° to about 80° with respect to the base plane.

32. The system of claim 30, wherein the planes which define the arcuate actuator-orienting guides are inclined at an angle of from about 20° to about 80° with respect to the opening plane.

33. The system of claim 31, wherein each wing has a lower edge and the entire lower edge of each wing curves continuously outwardly and upwardly from the body.

34. The system of claim 31, wherein the planes which define the arcuate actuator-orienting guides intersect each other on the base surface.

35. The system of claim 34, wherein each wing has a lower edge and the lower edge of each wing curves along a constant radius.

36. The system of claim 34, wherein the plurality of wings comprise at least one pair of wings, each wing has a lower edge, and the lower end of the actuator body and the lower edge of each wing define an upwardly curved surface.

37. A system for applying a mark having an initial width onto a surface which provides means for varying the width of the mark from its initial width comprising an aerosol container having an actuator, the actuator having a body which includes upper and lower ends, an axis which passes through the upper and lower ends of the body, a plurality of wings extending laterally from the actuator body a predetermined length, and a passage through the actuator which terminates in a substantially rectangular orifice through which marking material travels upon discharge from the container, the orifice located at the lower end of the actuator body, and a movable marking device having an opening therethrough and a planar surface about the opening comprising an insert which is rotatable with respect to the device comprising a base assembly, the base assembly comprising a base surface extending outwardly from an opening having a means for receiving and seating the actuator therein such that the actuator rotates when the insert is rotated, flange means integral with and extending from the base assembly such that the means contacts the planar surface about the device opening, and handle means for effecting rotation of the insert by an operator, wherein when an operator moves the handle means, the actuator rotates about its axis, causing the orifice to rotate such that the mark prepared by the discharge of material from the orifice varies in width.

38. The system of claim 37, wherein the base surface is at least partially disposed in a base plane, the base assembly further comprising at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of less than 90° to the base plane, the guides being capable of contacting the actuator as it is received in the base assembly, the guides being disposed relative to one another such that they rotate the actuator to guide the actuator into the seated position.

39. The system of claim 37, wherein the base surface is at least partially disposed in a base plane, the base assembly further comprising at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of less than 90° to the base plane and intersecting each other on the base surface, the guides being capable of contacting the actuator as it is received in the base assembly, the guides being disposed relative to one another such that they rotate the actuator to guide the actuator into the seated position.

40. The system of claim 37, wherein the base surface is at least partially disposed in a base plane, the base assembly further comprising at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of from about 20° to about 80° to the base plane, the guides being capable of contacting the actuator as it is received in the base assembly, the guides being disposed relative to one another such that they rotate the actuator to guide the actuator into the seated position.

41. The system of claim 37, wherein the base surface is at least partially disposed in a base plane, the base assembly further comprising at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of less than 90° to the base plane, the guides being capable of contacting the actuator as it is received in the base assembly, the guides being disposed relative to one another such that they rotate the actuator to guide the actuator into the seated position, and a first set of two planar surfaces, each planar surface of the first set extending upwardly and outwardly with respect to one of the guides and from at least a portion of the guide.

42. The system of claim 37, the movable marking device further comprising a holder into which the aerosol container is inserted, the holder comprising substantially cylindrically-shaped side walls and a bottom surface which comprises the planar surface about the opening of the device.

43. The system of claim 42, wherein the base surface is at least partially disposed in a base plane, the base assembly further comprising at least one wall extending upward from the base surface and defining two actuator-orienting guides, the guides being defined by substantially arcuate-shaped profiles substantially disposed in respective guide planes, the guide planes being disposed at an angle to one another of less than 180° and at an angle of less than 90° to the base plane, the guides being capable of contacting the actuator as it is received in the base assembly, the guides being disposed relative to one another such that they rotate the actuator to guide the actuator into the seated position.

44. An actuator for effecting discharge of material from an aerosol container upon insertion into a base, the actuator having upper and lower ends and a passage therethrough which terminates in an orifice through which the material travels upon discharge from the container, the orifice located at the lower end of the actuator, comprising an actuator body having an axis which passes through the upper and lower ends of the actuator, and at least one wing which extends from the actuator body, the at least one wing having a lower edge, the entire lower edge curving outwardly and upwardly from the body.

* * * * *